US006056638A

United States Patent [19]

Jones

[11] Patent Number: 6,056,638

[45] Date of Patent: May 2, 2000

[54] MINE VENTILATION WALL CONSTRUCTION

[76] Inventor: Ricky L. Jones, 214 S. Hampton Dr., Bristol, Tenn. 37620

[21] Appl. No.: 09/116,451

[22] Filed: Jun. 24, 1998

[51] Int. Cl.[7] ..... E21F 1/14

[52] U.S. Cl. ..... 454/169; 454/170

[58] Field of Search ..... 454/169, 170; 299/12

[56] References Cited

U.S. PATENT DOCUMENTS

| | | | |
|---|---|---|---|
| 1,478,303 | 12/1923 | Snyder | 454/170 |
| 3,636,852 | 1/1972 | Burgess, Jr. | 454/170 |
| 4,282,802 | 8/1981 | Divers et al. | 454/170 |
| 5,683,294 | 11/1997 | Maines | 454/170 |

FOREIGN PATENT DOCUMENTS

| | | | |
|---|---|---|---|
| 41 02 331 | 7/1992 | Germany | 454/170 |

*Primary Examiner*—Harold Joyce

[57] ABSTRACT

A ventilation passage system for a mine having a main shaft from which several branch shafts may extend, wherein each shaft has a generally flat floor and ceiling, the system being constructed of a series of substantially rectangular panels arrayed in at least one of the shafts with respect to the shaft walls to provide an air infeed and air return passage therefor, each panel being comprised of rigid, closed cell, foamed plastic material, the panels being in edge-to-edge abutment with each other longitudinally of the shaft, and each panel being forcefully wedged at its top and bottom edges between the ceiling and floor of the shaft.

8 Claims, 2 Drawing Sheets

MINE VENTILATION WALL CONSTRUCTION

BACKGROUND OF THE INVENTION

1. Field

This invention concerns coal or other type mine ventilation systems wherein fresh air is forced into the mine, typically thru its main gallery or shaft entrance or down thru vertical shafts or other passages, and is then directed by air flow barriers or stoppings of some sort deep into the main shaft or into branch shafts off of the main shaft. Such shafts often extend for miles into the earth in vertical. slanted or horizontal directions to follow the seams being mined.

In order for the ventilation air to be effective in both bringing oxygen and other necessary gasses to the work areas such as around the seam face, and then to evacuate worker respiration gasses such as CO and $CO_2$, mine gasses such as methane, and equipment fumes or the like from these areas, an actual ventilation channel must be established such that incoming and outgoing air are not inteniixed to a point where, e.g., $O_2$ concentration within the work area drops to a level unable to sustain proper respiration.

These barrier devices are used not Vonly to control and direct air flow but also to seal off portions of a mine no longer being worked or temporarily shut down. The barriers are typically installed in such a manner as to direct air flow to the working face and to stop air flow through cross cuts and entries which are not being worked. The ventilation air to be delivered under pressure to the working face can originate at a considerable distance from the face, and therefore, stoppings or barriers separating the crosscuts and entries must be substantially air-tight to prevent air flow losses which would significantly reduce the velocity of the air flow at the mine face. Such flow losses can easily diminish by half the induced air, simply through leaky stoppings and doors. Consequently, the dust and gases in the work area will not be effectively transported to the mine exit.

2. Prior Art

Heretofore, various air flow directing barrier, stoppings or brattice structures and techniques have been employed for constructing ventilatiton passages within mines as exemplified and described in U.S. Pat. Nos. 4,1880,352 and 4,516,879, the disclosures of which are hereby incorporated herein bv reference in their entirety. The structure of these patents are effective, to varying degrees, in directing air flow within mines. however, they suffer—in a practical sense—from being too expensive or complex to manufacture, to transport to and within the mine, to install, or in some cases to operate, such as roll-up curtains or the like. Also, under present Federal and State mining equipment standards, some of these prior structures cannot meet the rigorous requirements, e.g., of fire resistance and lateral impact strength.

As stated succinctly in U.S. Pat. No. 4,516,879, - - - "The construction and maintenance of mine stoppings is expensive and time consuming. Conventional stoppings consist of wsalls constructed of concrete block and cement, which are relatively difficult and costly to construct and maintain. For example, a typical coal mine stopping consists of about 160 concrete blocks, and at least one mining car is usually required to transport construction materials significant distances down into the mine to erect one mine stopping. Furthermore, a substantial amount of time and manpower is also required to construct such a mine stopping since each of the concrete blocks have to be individually set in place and cemented.

The rigidity of a mine stopping of this type makes it susceptible to deformation by convergent ground movements or shock from explosive charges. Failure of the stopping is manifested by the formation of the aforementioned air leaks or, in the worst case, by a total collapse of the masonry structure, thereby requiring reconstruction of the stopping in the operational maintenance of the mine ventilation svstem The elimination or reduction of stopping air leakage and of stopping failures is essential to the provision of a satisfactory ventilation efficiency in the mine, with resulting health and sanity benefits to the miners."

OBJECTS OF THE INVENTION

Objects therefore, of the present invention are: to provide a mine ventilation passage system and its method of installation wherein unique barrier panels are easily and rapidly installable within a mine, wherein the panels are easily and inexpensively manufactured and readily meet the most stringent functional and safety standards: to provide such panel structure which is easily dimensioned to size at the mine site, if necessary, in order to accommodate any ceiling height; to provide such panels with such structural integrity as to be readily and accurately installable within a mine in a substantially free standing, substantially sell supporting posture without the need for ancillary lateral supports, wherein only the mine ceiling and floor need contact the panel; to provide such panels which can readily accommodate during their installation, substantial vagaries in mine ceiling or floor contours; to provide such panels which can withstand severe vibration and sudden shock waves without cracking or crumbling; and to provide effective methods of installation for the present panels.

SUMMARY OF THE INVENTION

The above and other objects hereinafter becoming evident, have been attained in accordance with the present invention than discover of a ventilation passage system for mines having at least one main shaft or gallery from which several branch shafts may extend, wherein each said shaft has a generally flat floor and ceiling, said system comprising a series of substantially rectangular panel means arrayed in at least one of said shafts to provide air infeed and air return passage means therefor, said panel means being comprised of rigid, closed cell, foamed plastic material and being in end-to-end or side-to-side abutment with each other longitudinally of said shaft, and each said panel means being forcefully wedged at top and bottom edges thereof between the ceiling and floor or a structure thereon, of said shaft.

In certain preferred embodiments:

(a) said panels provide a substantially continuous wall which is spaced inwardly from the side walls and seam face of said shaft a distance which provides an air passage sufficiently large in cross-section to accommodate a desired infeed and return air flow;

(b) said panels extend in one piece from floor to ceiling;

(c) said panels are comprised of rigid, closed cell polyurethane foam having a density which gives a panel measuring 10 feet in length, 5½ in. thickness, and 5 ft. width a weight of from about 25 to about 35 lbs; and (d) said panels are crushable at their top and bottom edges by wedging pressures such that the edges can follow ceiling and floor contours, especially during and after strata movement which can occur in mine areas, and thus allow tight wedge fitting of the panels between ceiling and floor without adversely affecting the overall cellular integrity of the panel after installation.

BRIEF DESCRIPTION OF THE DRAWINGS

The invention will be further understood from the following drawings and description thereof wherein.

DETAILED DESCRIPTION

Figure 1:
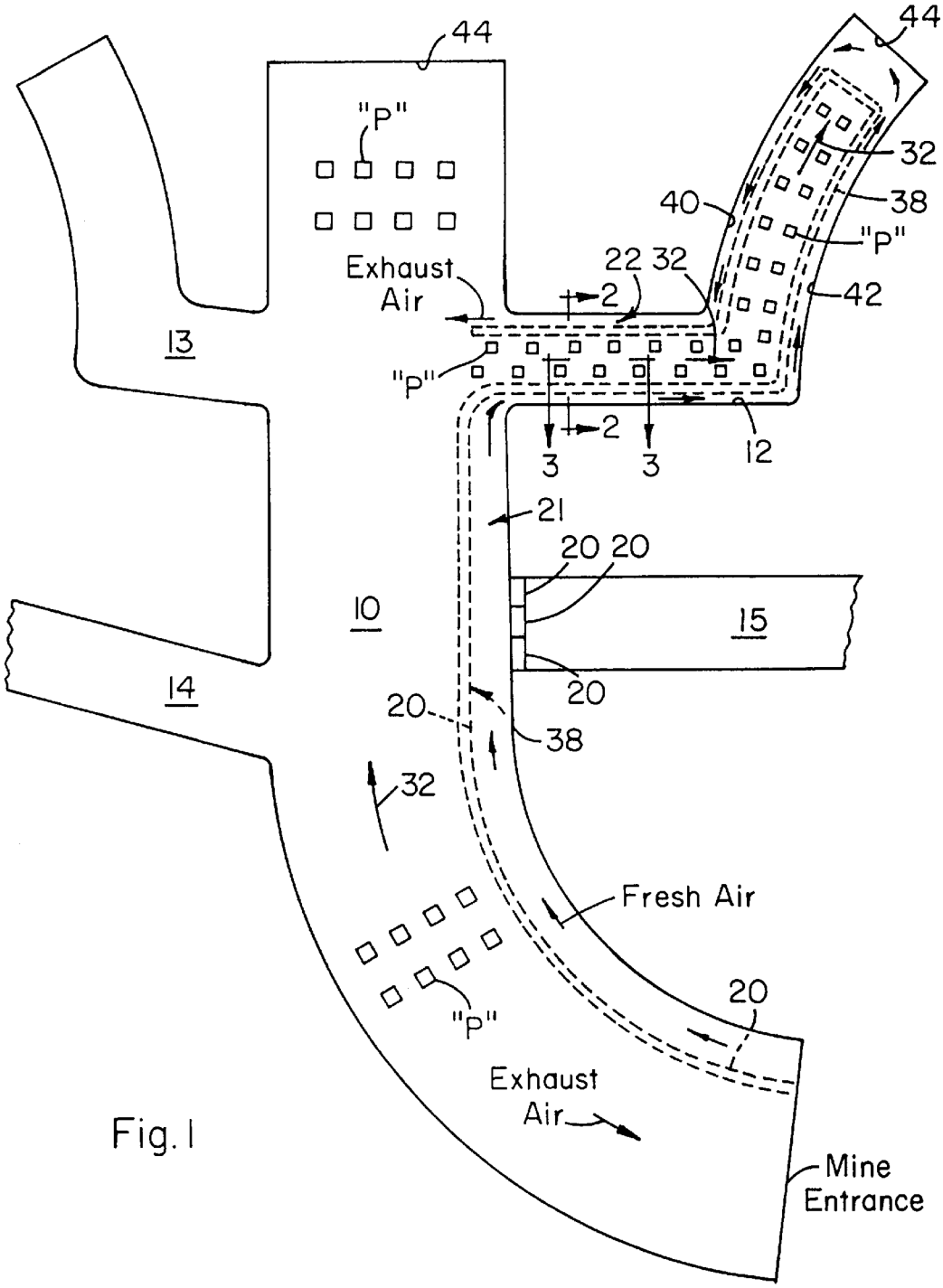
FIG. 1 is a schematic View of a coal mine interior showing a typical layout of some of the in-situ formed ceiling support pillars "P", i.e., coal pillars left in place during mining, and with the present air float directing panel means in place in a working branch shaft, and further showing the present panel means also sealing oft an idle shaft.

Referring to the drawings and with particular reference to the claims hereof, the present ventilation passage system is primarily designed for coal mines having at least one main gallery or shaft 10 and up to several branch shafts such as 12, 13, 14 and 15. Each shaft has a floor 16 and ceiling 18 which are generally flat, but which of course, will be somewhat irregular due to the contours generated by the mining operation. The present system comprises a series of substantially rectangular panel means 20 arrayed in one ear more of the shafts to provide air infeed and air return passage means 22 for the shaft being worked.

The panel means are comprised of rigid, closed cell, foamed plastic material 24 which are coated, preferably after their installation, on both sides to at least about ⅛ inch thickness with adhesive, fire-proof stopping sealant 23 such as Sandvik MTA or Sandvik SMS or Cisco Redi Seal to meet the mine noncombustible requirements as detelined by ASTM E-119-88 tests denoted, "Fire Tests of Building Construction and Materials". An example of this technology is found in U.S. Pat. No. 5,043,019 the disclosure of which is hereby incorporated herein in its entirety. These panels preferably provides structure having a one hour fire resistance as described in ASTM E119 and E72-80 of temperatures of 1000° F. to 1700° F. and a flame spread index of less than 25 as described in ASTM E162. The panels are also equivalent in transverse load strength (at least 30 psf) to an 8-inch hollow core concrete block stopping with mortared joints as determined by tests according to ASTM E72-80, "Conducting Strength Tests of Panels for Building Construction", Section 12—Transverse load-Specimen Vertical, load only. The panel means are placed in end 26-to-end 28 abutment 30 with each other, or side-by-side for higher ceilings, in a longitudinal direction 32 of said shaft, wherein each panel means is forcefully wedged at its top 34 and bottom 36 edges between the ceiling and floor of said shaft. The ends 26 and 28 of the panels, or the seam therebetween, also may be coated with said fire proofing material before or after installation to provide a more positive air seal.

Usefull polymeric material from which the foamed panels can be formed include polyurethane, cellulose esters, epoxy, phenolics, polyethylene, polystyrene, silicone, and urea-formaldehyde resins. The preferred rigid foamed panel, however, is of polyurethane.

These panels are preferably arrayed to provide a substantially continuous wall 38 shown in dotted line, which wall is spaced inwardly from the side walls 40 and 42 of the shaft, e.g., 4–6 feet or more, and several feet from the working face 44 of the shaft, which distances are designed to accommodate desired infeed and return air flow rates as well as equipment and personnel.

It is preferred that the panels extend in one piece from floor to ceiling and form a continuous sealing wall broken only by access doors or the like. It is noted the shaft height can vary from several feet, e.g., 15 feet or more down to three feet or so. The panels can be manufactured to any dimension, e.g., a thickness of from about two inches to about twelve inches, a width from about four feet to about six feet, and a length of from about six feet to about twenty feet, and a proper selection of panels and dimensions to which they can be cut at the mine site can be made to achieve the necessary strengths and other properties required. large panels can be given the larger thickness for lateral strength. It is noted that such foamed plastic panels are easily scored and broken or sawed to size at the job site such that they can readily be wedge-fitted between the ceiling and floor of the shaft. The panels, for higher ceilings, can be plastic cemented at their top and bottom edges to increase the height of the barrier panel wall.

Figure 4:
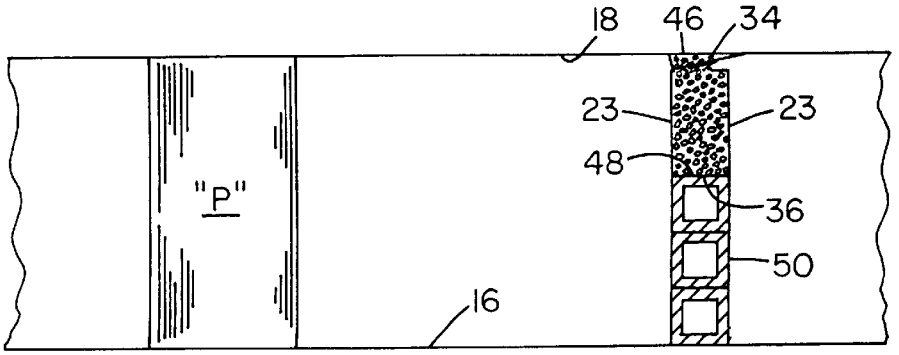
FIG. 4 is a cross-sectional view of a variation in usage of the present panels in combination with a conventional concrete block stopping wall and wedged by wedges between the shaft ceiling and floor.

Wedge-fitting the panels may be done as shown in FIG. 4 wherein the panels are wedged by cap wedges 46 driven between the shaft ceiling and panel across the top thereof. e.g., in six spaced places these wedges may, of course, alternatively be driven between the bottom edge 36 of the panel and the top edge 48 of cement blocks 50 or the shaft floor 16. The wedges can be formed from panel trimmings or comprised of some fire-proof material.

It is noted that any gaps at the top and bottom of the installed panels may be filled in with pieces of trimmed or broken panels and positioned in place by hammering or the like and then adhesively fixed in place and sealed with the aforesaid sealant.

A highly significant advantage in using the present panels is that they can be removed readily from a previous installation in the mine by simply forcing their top or bottom edges from their wedged positions to loosen the panels. Should such removal damage edge portions of the panels, sealant and panel pieces can easily be applied thereto right at the work site to reconstruct a proper edge. The costs savings in time and materials by way of such reuse is substantial.

Figure 2:
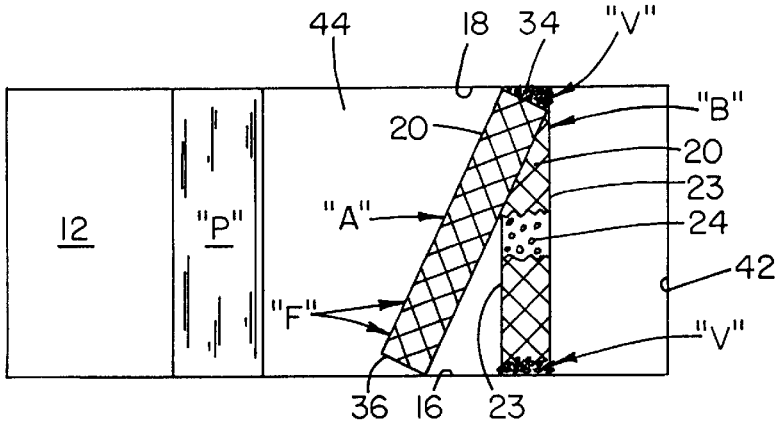
FIG. 2 is a view of the end of a panel taken in the direction of line 2—2 in FIG. 1 showing a panel in its initial stage of assembly and also in its wedged-in, completely installed, final position.
Figure 3:
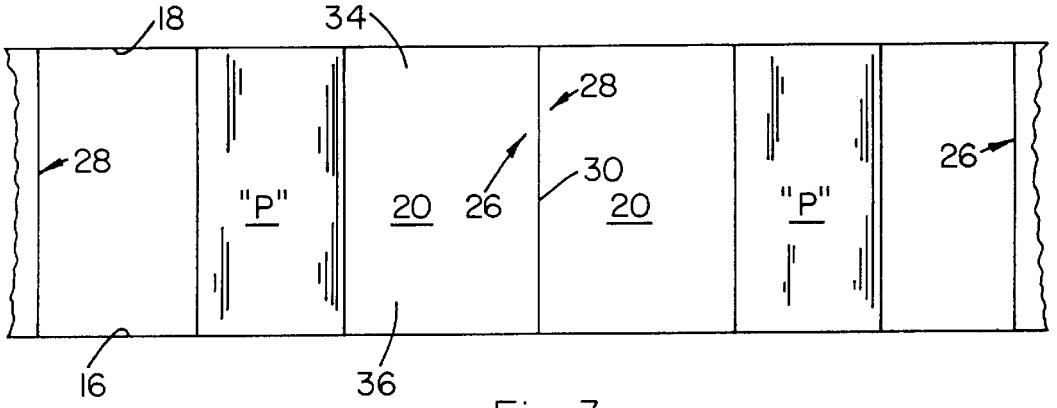
FIG. 3 is a view of taken in the direction of arrows 3—3 in FIG. 1 and showing panels in their installed, end-to-end abutment positions.

Using another installation technique as shown in FIG. 2, which technique is allowed by virtue of the present panel composition and structure, the top edge 34 of the panel is placed against the mine ceiling 18 an appropriate distance from the shaft wall 42 as in initial posture "A", and the bottom edge 36 of the panel is then forced to posture "B", e.g., by foot or hammer applied force, such as kicking or hammering the bottom of the panel generally along force lines "F". This procedure may, of course, be applied to the panel with the top and bottom edge initial and final postures reversed.

Sealant 23 should then be applied on both sides of the panels after installation, preferably to a thickness of ⅛–3/16 in. with Sandvik MTA/SMS or Cisco Redi Seal mine sealant this sealant is water based and essentially non-combustible.

It is particularly noted that the closed cell structure of the panels allows the high pressures developed at its top and bottom edges during the wedge-fitting operation to crumble some of the structurally rigid foam cell walls immediately adjacent the ceiling and floor and to cause a slight compression of the panel cells as shown for example, at "V" in the immediate vicinity, of the top and bottom edge faces. Such compression enhances the effect of the wedge-fitting forces and the resultant sealing of the ventilation air passage without adversely affecting the closed cellular integrity and strength of the overall panel as indicated at area 24 thereof wherein the closed cells are intact and non-compressed.

The present invention also provides large savings in installation time as shown by the following procedural steps in installing a two panel 5 ft. wide×5.5 in. thick×20 ft. long stopping weighing a total of 60 lbs.;

| | |
|---|---|
| Scale loose debris from rib | Less than 5 min. |
| Remove debris from mine floor | Less than 5 min. |
| Measure height and width of cut | Less than 5 min. |
| Trim panel to fit cut | Less than 5 min. |
| Coat back side of panels while panels are laying on mine floor | Less than 10 min. |
| Set panels in place | Less than 5 min. |
| Wedge panels (minimum 6 locations) | Less than 5 min. |
| Fill gaps using trimmings from panel | Less than 10 min. |
| Coat face of stopping | Less than 20 min. |
| Total Installation Time - | Approximately 1 hour. |

This invention have been described in detail with particular reference to preferred embodiments thereof, but it will be understood that variations and modifications will be effected within the spirit and scope of the invention.

I claim:

1. A ventilation passage system for mines having at least one shaft from which several branch shafts may extend, wherein each said shaft has a generally flat floor and ceiling, said system comprising a series of substantially rectangular panel means arrayed in at least one of said shafts to provide air infeed and air return passage means therefor, said panel means being comprised of rigid, closed cell, foamed plastic material, said panel means being in edgewise abutment with each other generally longitudinally of said shaft, and each said panel means being forcefully wedged at top and bottom edges thereof between the ceiling and floor or a structure thereon of said shaft.

2. The system of claim 1 wherein said panel means provide a substantially continuous wall which is spaced inwardly from the side walls and seam face of said shaft a distance which provides an air passage sufficiently large in cross-section to accommodate a desired infeed and return air flow.

3. The system of claim 1 wherein each said panel means extends in one piece from floor to ceiling.

4. The system of claim 1 wherein said panel means are comprised of polurethane foam having a density which gives a panel measuring 10 feet in length, 5½ in thickness, and 5 ft. width a weight of from about 25 to about 35 lbs.

5. The passage means of claim 1 wherein said panel means are crushable by high pressures at their top and bottom edges to allow said edges to follow ceiling and floor contours and to allow tight wedge-fitting of the panels between ceiling and floor or a structure thereon without adversely affecting the overall cellular integrity of the panel after installation.

6. A method for erecting an air flow ventilation passage system for a mine having a main shaft from which several branch shafts may extend, wherein each shaft has a generally flat floor and ceiling, said method comprising providing a plurality of substantially rectangular panels of rigid, closed cell polyurethane, forming said panels to the approximate height of the mine ceiling above the mine floor or above a structure thereon, placing a first panel in an initial position within said shaft to be secured therein in a generally vertical posture and spaced from the shaft wall, forcing said panel into a wedged final substantially vertical posture between the mine ceiling and its floor or a structure thereon whereby the foam cell walls adjacent top and bottom edges of the panel are fractured or compressed to provide a tight wedging action, placing a second such panel into said initial position and into edge-to-edge abutment with said first panel, and forcing said second panel into said wedged final substantially vertical posture whereby said panels form a continuous wall segment.

7. The method of claim 6 wherein one or both sides of said panels are coated with a fire proofing, adhesive material to provide a continuous fire proofing face.

8. The method of claim 7 wherein said panels are arrayed in at least one of the shafts with respect to the shaft walls to provide an air infeed and air return passage therefor, each panel being comprised of rigid, closed cell, foamed plastic material, the panels being in edge-to-edge abutment with each other longitudinally of the shaft, and each panel being forcefully wedged between the ceiling and floor of the shaft.

* * * * *